United States Patent [19]

von Knorring et al.

[11] 4,347,885

[45] Sep. 7, 1982

[54] ROLLER BLIND STRUCTURE

[76] Inventors: Enar S. von Knorring, 38 Varkevagan, 770 20 Soderbarke; Torsten F. Swensson, 76 Vastmannagatan, 113 26 Stockholm, both of Sweden

[21] Appl. No.: 95,039

[22] Filed: Nov. 16, 1979

[30] Foreign Application Priority Data

| | | | |
|---|---|---|---|
| Nov. 16, 1978 | [SE] | Sweden | 7811856 |
| Apr. 27, 1979 | [SE] | Sweden | 7903741 |
| Sep. 4, 1979 | [SE] | Sweden | 7907364 |

[51] Int. Cl.[3] ..... E06B 9/206

[52] U.S. Cl. ..... 160/242; 160/307; 160/320; 160/322; 160/323 B

[58] Field of Search ..... 160/319, 320, 323 R, 160/323 B, 242, 243, 244, 307, 322; 248/266, 267, 268, 269

[56] References Cited

U.S. PATENT DOCUMENTS

| | | | |
|---|---|---|---|
| 177,482 | 5/1876 | Dohen | 160/307 X |
| 305,455 | 9/1884 | Kempster | 160/242 |
| 917,983 | 4/1909 | Wilson | 160/322 X |
| 923,050 | 5/1909 | Kummer | 160/307 |
| 1,554,845 | 9/1925 | Gizzi | 160/319 |
| 1,829,853 | 11/1931 | Divinia | 160/319 X |
| 3,916,974 | 11/1975 | Lidin | 160/319 |
| 3,934,832 | 1/1976 | Zilver | 160/319 X |
| 4,226,396 | 10/1980 | Bowers | 248/268 |
| 4,262,729 | 4/1981 | von Knorring | 160/242 |

FOREIGN PATENT DOCUMENTS

| | | | |
|---|---|---|---|
| 65054 | 7/1942 | Norway | 160/242 |

*Primary Examiner*—Rodney H. Bonck

*Attorney, Agent, or Firm*—William A. Drucker

[57] ABSTRACT

A roller blind structure has an elongated tubular member which is mounted for rotation and displacement in elongated openings in two spaced-apart brackets. Coaxially secured to the tubular member is a pulley. The roller blind screen is secured to the tubular member, and a cord for rotating the tubular member is secured to the hub of the pulley. A tubular sleeve having a downwardly directed opening for the cord has an axial projection sliding against an upper horizontal surface of the bracket to prevent the sleeve from rotating but to allow it to be displaced with the pulley A guiding and locking means is provided at a vertical spacing below the sleeve and serves to guide the cord relative to the sleeve and to lock the cord in any desired position. For the latter purpose, it has a spring-influenced locking arm. To the free end of the cord is secured a resilient knob and the guiding and locking means has an inclined end wall for cooperation with said knob to cause the latter to take an inclined position in its uppermost position. The lock arm may also have a resilient braking element.

4 Claims, 9 Drawing Figures

ROLLER BLIND STRUCTURE

This invention refers to a roller blind structure.

BACKGROUND OF THE INVENTION

More specifically the invention refers to a roller blind structure comprising cylindrical member having secured thereto one end of a screen and being rotatably mounted in two axially spaced apart brackets and being further provided with a pulley to the hub of which is secured one end of a cord, said cord being intended to be wound upon said hub in a direction opposite to the direction in which said screen is wound upon said cylindrical member, such that unwinding cord from said pulley results in said screen being wound upon said cylindrical member and vice versa.

THE PRIOR ART

The conventional roller blind also comprises an elongated cylindrical member but said member is under the influence of a torsion spring urging said screen to be wound upon said member, and a locking or arresting means, usually actuated by means of centrifugal weights, is further provided to arrest said cylindrical member in any desired angular position. This conventional roller blind structure is rather complicated and has a number of drawbacks, for instance the difficulty in stopping the screen in a desired position, the bang occurring when the screen is wound up, the soiling of the screen when it is grabbed to wind up the screen and the fact that the screen will be situated at a distance from the window frame when in its rolled down position, thereby causing loss of heat, draught and an insufficient light shielding. Several attempts have therefore been made to provide a roller blind without the disadvantages of the conventional roller blind, and as it is obvious that the kind of roller blind to which this invention refers may to a great extent eliminate these drawbacks, attempts have been made to practice the principles of said roller blind structure in designing such a roller blind.

However, such attempts have not been successful, depending upon the difficulty of having the cord upon said pulley and unwound therefrom without disturbances such as the cord jumping off the pulley, tanglings, knots and so forth, and also upon the difficulty of obtaining a safe, simple and precise locking of the screen in any desired position of winding.

OBJECTS OF THE INVENTION

The primary object of the invention is thus to provide a roller blind of the kind referred to without any of said drawbacks.

A further object is to provide a roller blind structure in which the cylindrical member, during unrolling of the screen therefrom, moves towards the window frame to enable said screen to come into contact with said window frame and thereby guarantee an effective light and heat shielding effect.

Still further objects will be apparent from the following description taken in connection with the appended claims and accompanying drawings.

SUMMARY OF THE INVENTION

In order to accomplish the objects, the roller blind structure is carried out according to the appended claims

BRIEF DESCRIPTION OF THE DRAWINGS

The accompanying drawings illustrate an exemplary embodiment of the invention, and in the drawings.

DESCRIPTION OF THE PREFERRED EMBODIMENT

Figure 1:
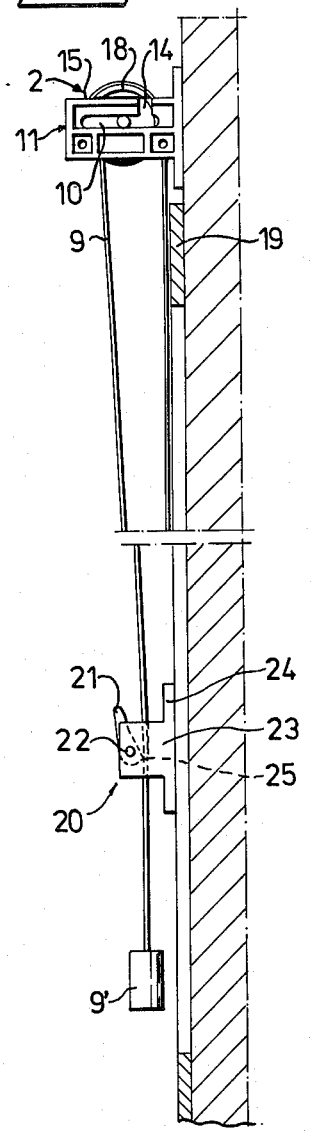
FIG. 1 is a side view of the new roller blind structure.
Figure 2:
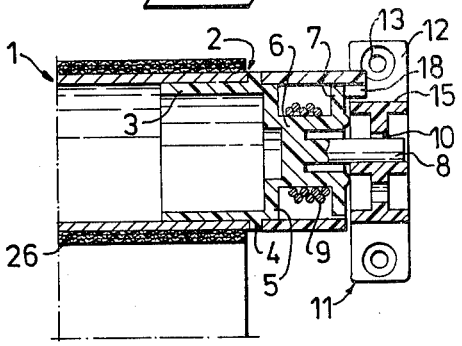
FIG. 2 is a front view partly in section of one end of the roller blind structure.
Figure 3:
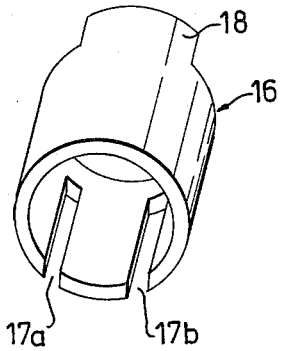
FIG. 3 is a perspective view of a guide sleeve of the roller blind structure.

The roller blind structure according to the drawing comprises a tubular member 1, having secured to each of the ends thereof a respective end member, only one of said end members 2 being shown. Said end member 2 has a tubular portion 3, frictionally inserted in the end of the tube 1, a flange 4 seating at the end of tube 1, a circular guiding surface 5 forming one flange of a pulley, the hub of said pulley being designated by reference numeral 6, and another flange having reference number 7, and from said flange 7 there projects a stud portion 8. As seen, the diameter of hub 6 is considerably smaller than that of tube 1 for a purpose to be described. The end member not shown differs from the one now described only in that it lacks the portions 5-7 forming the pulley.

A cord 9 has one end thereof secured to hub 6 and is intended to be wound upon said hub in such a manner that pulling the cord causes tube 1 to move in an anticlockwise direction according to FIG. 1.

The studs 8 of the tube are mounted in elongated openings 10 in brackets 11, having each a substantially planar attachment portion 12 with screw holes 13. Said brackets are preferably made from a plastics material with resilient properties such as acetal plastics. At least one of said brackets has a vertical slot 14 communicating with the elongated opening 10 via a restricted area which makes it possible to introduce the stud 8 in said opening 10 by introducing it in said slot 14 and slightly pressing it through said restricted area. The surface from which slot 14 extends is designated as 15.

A tubular sleeve 16 is mounted with some clearance around the flanges 5, 7 of the pulley such that said pulley is rotatable in said sleeve, and the latter further has two slots, 17A, 17B, extending from one end thereof and being substantially tangential to a smaller circle concentric with the sleeve. One of said slots is used to allow the cord 9 to pass there through and the reason why there are two slots is that the sleeve may be alternatively used for mounting at the left-hand side of the roller or at the right-hand side thereof. Sleeve 16 further has a projection 18 axially extending from the opposite end thereof and said projection is arranged to slide along surface 15 of the bracket, thus preventing said sleeve from rotating with the pulley but allowing it to be displaced towards the window frame as well as away therefrom. The width of each slot 17A, 17B slightly exceeds the diameter of the cord and the depth is such that said cord in the winding and unwinding process contacts the end surface of said slot, thereby giving a tendency of reversing the winding direction axially, which results in a proper winding in layer after layer. A condition for the proper winding and unwinding in an axial direction as well as in the radial direction is that the angle of the cord relative to the sleeve is always held within certain limits. For this, and another purpose to be described, the cord is passed through a guiding and locking means 20, preferably secured to the window frame 19 and comprising a spring-influenced arm 21 pivoted at 22 to a U-shaped bracket 23, the web portion 24 thereof having screw holes for attachment to said window frame and the flanges thereof having holes 22 for pivot pins integral with said arm 21 or a pivot pin extending also through a hole in said arm. Arm 21 further has a locking projection 25 and since the spring (not shown) tends to pivot the arm in an anti-clockwise direction in FIG. 1, and since said projection has the end thereof situated at a small vertical distance below the pivot center, the projection will press the cord 9 against the web portion 24 of bracket 25 and thus lock it. This is the locking function of the guiding and locking means 20. When arranging said guiding and locking means at a vertical distance, in practice exceeding 30 cm, below sleeve 16, the cord 9 will always extend at such an angle to said sleeve slot that the proper winding performance as explained is guaranteed, and this is the guiding function of member 20.

A screen or curtain 26 is secured to tube 1 and is wound thereupon in a direction opposite to the winding direction of the cord, and has in a manner known PER SE a pocket at the lower end thereof to receive a weight in the shape of a rib or the like to hold the screen straight.

The roller blind described above functions as follows:

If it is desired to have the screen or curtain fully rolled up from the position of FIG. 1, wherein it is only partly rolled up, it is only necessary to grasp a stop member 9' secured to the cord and pull it downwardly. Arm 21 will then be pivoted slightly in a clockwise direction to allow the cord to be free to move. Cord is now unrolled from pulley 5-7 and, as a consequence thereof, screen 26 will be rolled upon tube 1. Since the diameter of hub 6 of pulley 5-7 is only about 50% of the diameter of the tube 1, a correspondingly larger amount, about twice the length, of screen will be rolled up. When the screen has been rolled up, the stop member 9 is released and arm 21 then immediately moves back to its locking position and locks the cord and consequently the screen also.

In this movement, tube 1 has moved out from the window frame since the studs 8 roll over the lower surface of opening 10.

In order to roll down the screen, it is only necessary to actuate arm 21 in a clockwise direction by slightly pressing the free end thereof in the direction towards the window frame. The projection 25 will now release the cord and by gravity the screen will roll down. This movement occurs rapidly when arm 21 is fully depressed but slowly if the arm 21 is only partly pressed down, and by releasing arm 21 the screen is instantly stopped in any desired position.

In this unrolling action, tube 1 has been moved towards the window frame, owing to the fact that the studs 8 roll against the lower surface of opening 10 and as a consequence thereof the screen 26 sealingly engages the window frame, thereby minimising draught and loss of heat from the room and maximising the light shielding effect of the roller blind.

By means of the sleeve 16 being non-rotatably but displaceably mounted relative to the bracket, and by providing the means for guiding the cord relative to said sleeves, the winding and unwinding of the cord takes place in a fully controlled manner, and by further giving said guiding means a locking function it is possible to have the screen locked in any desired position in a very simple and reliable manner.

The roller blind structure now described eliminates every drawback referred to above and also makes it easy to change the screen by merely separating the lock arm 21 from its bracket 23 and lifting up the tube with its studs 8 via the slots 14.

Figure 4:
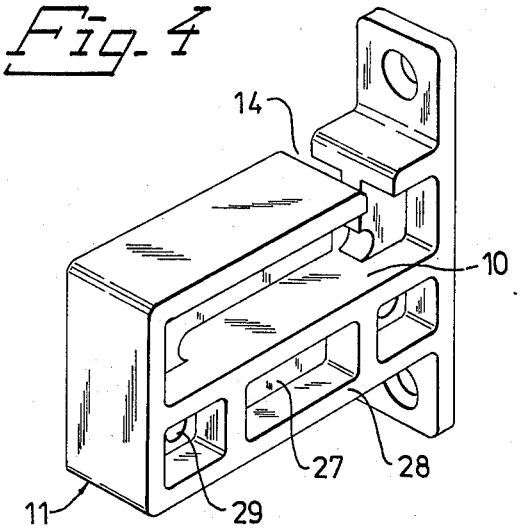
FIG. 4 is a perspective view of one of the brackets for the roller blind structure.

In this operation, as well as in changing the cord, it is advantageous that the slot 17A or 17B is open, as it makes it possible to introduce a new cord in the sleeve as well as to remove an old cord therefrom in a very easy manner. As can be seen in FIG. 4, the brackets 11 may have a central wall 27 and flanges extending in both directions therefrom (28), and by arranging screw holes 29 in said central wall the brackets may also be secured to, for instance, a door frame.

Figure 5:
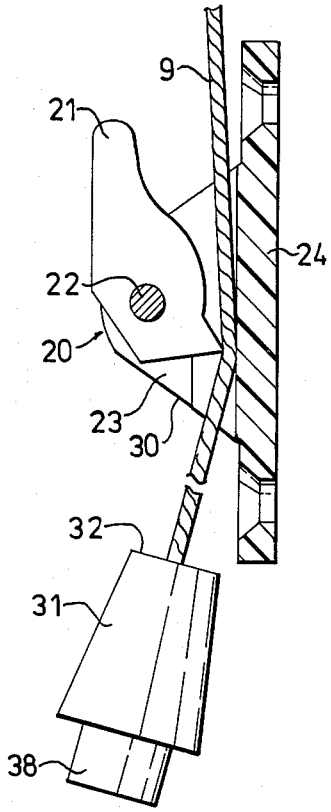
FIG. 5 is a section through a guiding and locking means for the roller, seen in the locking position thereof.
Figure 6:
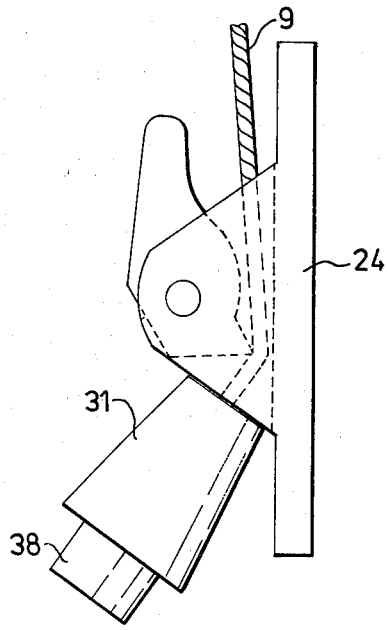
FIG. 6 is a side view of the means of FIG. 5, seen in a nonlocking position thereof.
Figure 8:
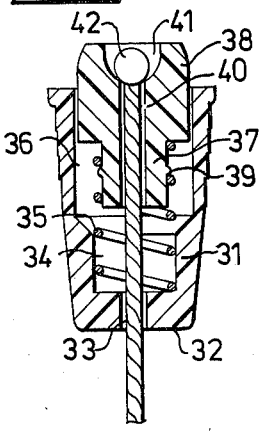
FIG. 8 is a section through a shock absorbing knob for the cord of the roller blind structure.

In practice it has been found that the bracket 23 of FIG. 1, in order to give sufficient space for a hand to grasp the stop member 9, must be given a rather considerable height and it has also been found that the rapid falling down of the screen or curtain, and consequently the sudden impact of the stop member against the bracket, gives the cord a tendency to be torn off after some period of use. These drawbacks have been eliminated by designing the guiding and locking means as seen in FIGS. 5 and 6 wherein the U-shaped bracket 23 has the flanges thereof provided with a sloping lower surface 30, and the stop means 9 is substituted by a resilient stop member 31, 38 having a surface 32 substantially perpendicular to the cord passing therethrough. As appears from FIG. 8, the stop member comprises a first member 31 having a first axial bore 33 for the passage of the cord, a second axial bore 34 receiving with friction one end of a coil spring 35, and a third axial bore 36. The opposite end of said spring 35 is fitted over a neck portion 37 of a second member 38, being slideably received in said bore 36 of the first member. The neck portion has an annular bead 39 over which one or two windings of the spring 35 are pressed when the assembling takes place. The assembling is extremely simple in that the part are merely brought into position and pressed together, whereupon they form a unit. The cord 9 is threaded through hole 33 and through a hole 40 in member 38 and is formed into a knot 41.

Figure 7:
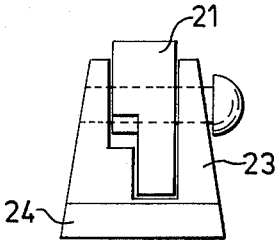
FIG. 7 is an end view of the means of FIGS. 5 and 6.

When the screen is to be rolled down, arm 21 is operated as described and thus leaves the position of FIG. 5. The screen then moves downwardly but when the screen is almost rolled out, the surface 32 of knob 31, 38 comes into contact with the sloping surfaces 30 of the bracket 23. The surface 32 will then first slide upon the sloping surfaces with a linear contact but then the tension in the cord will force the knob to tilt such that the entire surface 32 is pressed against the sloping surfaces 30. The knob then assumes the position of FIG. 6. A continued tension in cord 9 causes member 38 to move into member 31 against the action of spring 35. The tension upon the cord is considerably reduced by the actions now described and at the same time the knob 32, 38 takes up an angular position making it easy to grasp in spite of a very low and neat construction of bracket 23. As seen in FIG. 7 a rivet may be used as a pivot for arm 21, and by giving the flanges of the bracket 23 a sloping shape, a finger nail may be used for removing said rivet when disassembling of the guiding and locking means is to take place.

Figure 9:
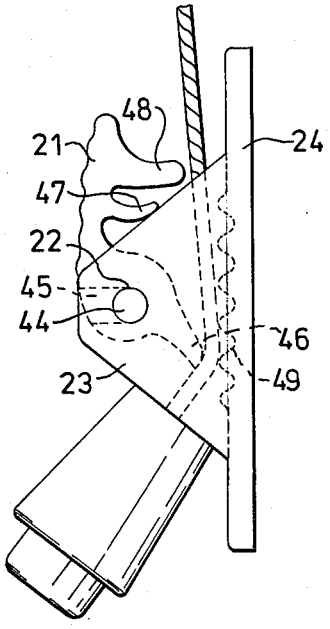
FIG. 9 is a section through a modified guiding and locking means of the roller blind structure.

In FIG. 9 an improved guiding and locking means having also a brake effect is illustrated. According to this embodiment, arm 21 has integral therewith short studs 44 preferably with tapered or spherical ends and the flanges of bracket 23 are resilient and have sloping internal entrance surfaces 45 ending in the pivot holes, thereby enabling the arm to be removed from the bracket by merely bending said flanges out from each other such that the studs 44 may leave the pivot holes of said flanges. The projection 25 is substituted by a resilient projection 46, and the arm further has a resilient tongue 47 engaging some part of the bracket to form a substitute for a separate coil spring. Arm 21 still further has a resilient projection 48 intended to act upon the cord. By designing arm 21 in such a manner the following advantages are obtained: Assembling of the guiding and locking means is considerably facilitated in that no separate coil spring is needed, and arm 21 may be mounted merely by pressing the arm into its position. Said flanges are resilient and snap back to their initial position as soon as the studs have properly reached the pivot holes. The function is also considerably improved in that a rapid rolling down of the screen is obviated by means of the resilient braking tongue 48 coming into contact with the cord as a result of slightly pressing the arm. By pressing harder the breaking effect is increased and in fact the normal actuation of the arm gives the desired effect in that in the first moment the cord is completely freed, giving as a result an immediate start of the rolling down movement. In pressing down arm 21, the resilient tongue 48 then comes into contact with cord 9 and begins to retard the speed of the cord which is accelerated by the falling screen. The successively increasing braking effect therefore counteracts the successively increasing acceleration of the screen, and an approximately constant speed of the screen is obtained. In practice it has been found that people unfamiliar with the new roller blind initially often try to pull the screen downwards, as with a conventional roller blind. Such an operation would cause damage to the pivot pins or the bracket flanges and in order to eliminate such a damage the projection 46 is resilient in the sense that when an excessive force is used thereupon it will flex such that arm 21 may be swung in an anti-clockwise direction beyond the locking position thereof. Of course, the cord is then free to run until knob 31, 38 stops such movement, but the normal function of arm 21 is then easily restored by pivoting the arm back to its initial position. Of course, the resiliency of the projection 46 is to be calibrated such that pivoting beyond the locking position is only possible when exerting a pressure exceeding the force which is apparent during the normal locking work thereof.

We claim:

1. A roller blind structure comprising:

(i) two spaced apart brackets each having an elongated opening, one of said brackets having an elongated locking surface substantially parallel to its elongated opening, (ii) an elongated roller having at each and an axially projecting stud rotatably and displaceably engaged in a said elongated opening of a respective bracket, said roller having one end of a screen secured thereto, (iii) a pulley secured to said roller and having a hub between two flanges, (iv) a cord secured to the hub of the pulley and wound upon said hub in the direction opposite to the direction in which the screen is wound on the roller, (v) a sleeve rotatably receiving at least one of said flanges of said pulley and including an opening permitting passage of said cord there through, said sleeve including an axial projection disposed to abut and slide along said locking surface of said one bracket for preventing rotation of said sleeve relative to said bracket, (vi) a guiding and locking member for guiding said cord relative to said opening of said sleeve and for locking said cord in any desired condition of being wound on said hub, said guiding and locking member being located at a spacing below said sleeve and comprising a manually-actuatable resiliently-loaded locking arm arranged to press said cord against a body portion of said guiding and locking member such that the cord may be pulled past the arm in the direction to wind up said screen on said roller, but such that said cord is locked against movement in the opposite direction until said arm is moved against its loading to free the cord.

2. A roller blind structure comprising:

(i) two spaced apart brackets each having an elongated opening, (ii) an elongated roller having at each end an axially projecting stud rotatably and displaceably engaged in a said elongated opening of a respective bracket, said roller having one end of a screen secured thereto, (iii) a pulley secured to said roller and having a hub between two flanges, (iv) a cord secured to the hub of the pulley and wound upon said hub in the direction opposite to the direction in which the screen is wound on the roller, (v) a sleeve rotatably receiving at least one of said flanges of said pulley and including an opening permitting passage of said cord therethrough, said sleeve being non-rotatably engaged with one of said brackets and having its opening directed downwardly, (vi) a guiding and locking member for guiding said cord relative to said opening of said sleeve and for locking said cord in any desired condition of being wound on said hub, said guiding and locking member being located at a spacing below said sleeve and comprising a manually-actuatable resiliently-loaded locking arm arranged to press said cord against a body portion of said guiding and locking member such that the cord may be pulled past the arm in the direction to wind up said screen on said roller, but such that said cord is locked against movement in the opposite direction until said arm is moved against its loading to free the cord, (vii) a resilient knob secured to said cord, said knob comprising two members slidably mounted one in the other and each frictionally connected to a coil spring, said guiding and locking means having an inclined surface against which an end surface of said resilient knob comes to rest when the screen is rolled down, thus giving the knob an inclined orientation in said position.

3. A roller blind structure comprising:

(i) two spaced apart brackets each having an elongated opening, (ii) an elongated roller having at each end an axially projecting stud rotatably and displaceably engaged in a said elongated opening of a respective bracket, said roller having one end of a screen secured thereto, (iii) a pulley secured to said roller and having a hub between two flanges (iv) a cord secured to the hub of the pulley and wound upon said hub in the direction opposite to the direction in which the screen is wound on the roller, (v) a sleeve rotatably receiving at least one of said flanges of said pulley and including an opening permitting passage of said cord therethrough, said sleeve being non-rotatably engaged with one of said brackets and having its opening directed downwardly, and (vi) a guiding and locking member for guiding said cord relative to said opening of said sleeve and for locking said cord in any desired condition of being wound on said hub, said guiding and locking member being located at a spacing below said sleeve and comprising a manually-actuatable resiliently-loaded locking arm arranged to press said cord against a body portion of said guiding and locking member such that the cord may be pulled past the arm in the direction to wind up said screen on said roller, but such that said cord is locked against movement in the opposite direction until said arm is moved against its loading to free the cord, said locking arm having a resilient braking projection so located that it comes into contact with the cord after said locking arm has been pivoted so as to free said cord.

4. A roller blind structure comprising:

(i) two spaced apart brackets, each bracket being made of a plastic material, each bracket having a first planar portion with holes for securing the bracket to a support, each bracket having a second portion perpendicular to said first portion, said second portion having an elongated opening, said second portion having a vertical slot leading from an upper surface of said second portion to said elongated opening via a restricted area, said second portion having holes for securing said bracket to a support, (ii) an elongated roller having at each end an axially projecting stud rotatably and displaceably engaged in said elongated opening of a respective bracket, said studs having a diameter which is slightly greater than said restricted area of said second portion of said bracket, said roller having one end of a screen secured thereto, (iii) a pulley secured to said roller and having a hub between two flanges (iv) a cord secured to the hub of the pulley and wound upon said hub in the direction opposite to the direction in which the screen is wound on the roller, (v) a sleeve rotatably receiving at least one of said flanges of said pulley and including an opening permitting passage of said cord therethrough, said sleeve being non-rotatably engaged with one of said brackets and having its opening directed downwardly, and (vi) a guiding and locking member for guiding said cord relative to said opening of said sleeve and for locking said cord in any desired condition of being wound on said hub, said guiding and locking member being located at a spacing below said sleeve and comprising a manually-actuatable resiliently-loaded locking arm arranged to press said cord against a body portion of said guiding and locking member such that the cord may be pulled past the arm in the direction to wind up said screen on said roller, but such that said cord is locked against movement in the opposite direction until said arm is moved against its loading to free the cord.

* * * * *